US007100525B1

(12) United States Patent
Price et al.

(10) Patent No.: US 7,100,525 B1
(45) Date of Patent: Sep. 5, 2006

(54) SYSTEM AND METHOD OF FINISHING RUFFLED GUSSETS/BORDERS

(75) Inventors: Elvin C. Price, Decula, GA (US); Samuel B. Goodwin, Lilburn, GA (US); Jeffrey A. Moore, Lawrenceville, GA (US); Preston B. Dasher, Lawrenceville, GA (US); Tadeusz Olewicz, Hoschton, GA (US)

(73) Assignee: Atlanta Attachment Company, Inc., Lawrenceville, GA (US)

( * ) Notice: Subject to any disclaimer, the term of this patent is extended or adjusted under 35 U.S.C. 154(b) by 0 days.

(21) Appl. No.: 10/774,035

(22) Filed: Feb. 6, 2004

Related U.S. Application Data

(60) Provisional application No. 60/446,188, filed on Feb. 10, 2003, provisional application No. 60/448,523, filed on Feb. 20, 2003, provisional application No. 60/457,517, filed on Mar. 25, 2003.

(51) Int. Cl.
*D05B 11/00* (2006.01)
*D05B 35/08* (2006.01)

(52) U.S. Cl. ..... 112/475.08; 112/2.1; 112/132

(58) Field of Classification Search ..... 112/132, 112/2.1, 147, 152, 153, 136, 137, 475.06, 112/475.08, 475.03, 475.04, 134; 5/717
See application file for complete search history.

(56) References Cited

U.S. PATENT DOCUMENTS

| | | | | |
|---|---|---|---|---|
| 1,233,945 A | | 7/1917 | Wodsedalek | |
| 1,926,650 A | * | 9/1933 | Reimer et al. | 5/717 |
| 1,947,058 A | | 2/1934 | Pittoni | 112/3 |
| 2,025,355 A | | 12/1935 | Mitchell | |
| 2,336,952 A | | 12/1943 | Olson | |
| 2,355,960 A | | 8/1944 | Duffie | |
| 2,772,425 A | | 12/1956 | Brodie | |
| 2,945,238 A | | 7/1960 | Weiser | |
| 2,975,437 A | | 3/1961 | Freeman | |
| 3,013,513 A | | 12/1961 | Judelson | 112/203 |
| 3,109,182 A | | 11/1963 | Doak | |
| 3,190,247 A | | 6/1965 | Schifano et al. | |
| 3,490,061 A | | 1/1970 | Docker | 112/2.1 |
| 3,641,954 A | | 2/1972 | Kalning et al. | 112/3 |
| 3,673,906 A | | 7/1972 | Cash | 83/208 |
| 3,802,361 A | | 4/1974 | Block | |
| 3,824,964 A | | 7/1974 | Ryan | 223/30 |
| 4,013,026 A | | 3/1977 | Hall | 112/153 |
| 4,014,273 A | | 3/1977 | Kosakai | |

(Continued)

FOREIGN PATENT DOCUMENTS

DE 31 39426 A1 4/1983

(Continued)

OTHER PUBLICATIONS

Yamaichi, Tape Binding and Sewing Robot System, Y&Y-RB-A System.

(Continued)

*Primary Examiner*—Ismael Izaguirre
(74) *Attorney, Agent, or Firm*—Womble Carlyle Sandridge & Rice, PLLC

(57) ABSTRACT

A system for forming and attaching pillowtop attachment gussets and borders to panels, with the gusset or border material being fed from a supply into a sewing station. The gusset or border material is passed through a folder assembly that directs the gusset or border material into a sewing zone where it is attached to the panel. A ruffler mechanism engages and forms a series of ruffles in the gusset or border material as it is sewn about the corners of the panel.

32 Claims, 6 Drawing Sheets

U.S. PATENT DOCUMENTS 4,019,447 A 4/1977 Blessing et al. ..... 112/121.11
4,025,975 A 5/1977 Phillips et al.
4,043,282 A 8/1977 Fanghanel ..... 112/3
4,061,327 A 12/1977 Blessing ..... 270/78
4,067,269 A 1/1978 Fanghanel ..... 112/3
4,073,246 A 2/1978 Crawford et al.
4,108,094 A 8/1978 Weigert
4,115,886 A 9/1978 Miller ..... 5/365
4,117,790 A 10/1978 Hasegawa et al. ..... 112/309
4,141,304 A 2/1979 Masuda ..... 112/153
4,181,085 A 1/1980 Conner, Jr. ..... 112/121.12
4,245,576 A 1/1981 Crawford et al.
4,280,421 A 7/1981 Price
4,290,376 A 9/1981 Brusasca ..... 112/121.26
4,424,600 A 1/1984 Callaway
4,432,294 A 2/1984 Price et al.
4,460,350 A 7/1984 Mittal et al. ..... 493/412
4,462,129 A 7/1984 Brannock ..... 5/474
4,463,466 A 8/1984 May et al. ..... 5/475
4,466,367 A 8/1984 Price et al.
4,498,404 A 2/1985 Sadeh ..... 112/121.12
4,527,492 A 7/1985 Gill
4,644,883 A 2/1987 Guin et al.
4,680,821 A 7/1987 Maguire
4,691,651 A 9/1987 Junemann ..... 112/259
4,703,706 A 11/1987 Plante
4,730,706 A 3/1988 Taylor et al. ..... 112/265.1
4,742,789 A 5/1988 Pestel et al. ..... 112/262.3
4,776,579 A 10/1988 Romand et al. ..... 271/228
4,794,873 A 1/1989 Dordi et al. ..... 112/2.1
4,809,375 A 3/1989 Bull
4,813,364 A 3/1989 Boser
4,821,656 A 4/1989 Dordi et al. ..... 112/2.1
4,825,787 A 5/1989 Babson et al. ..... 112/262.3
4,827,856 A 5/1989 Rohr ..... 112/63
4,838,186 A 6/1989 Resta et al. ..... 112/2.1
4,893,574 A 1/1990 O'Neal et al.
4,901,657 A * 2/1990 Fieschi ..... 112/152
4,903,622 A * 2/1990 Frey et al. ..... 112/152
4,905,615 A 3/1990 Pofferi ..... 112/2.1
4,958,579 A 9/1990 De Weers ..... 112/2.1
4,998,965 A 3/1991 Easom ..... 112/305
5,018,462 A 5/1991 Brocklehurst ..... 112/121.12
5,029,542 A * 7/1991 Ferguson ..... 112/134
5,042,098 A 8/1991 Stultz ..... 5/495
5,134,947 A 8/1992 Price et al.
5,137,190 A 8/1992 Plaud
5,145,144 A 9/1992 Resta et al. ..... 248/637
5,159,889 A 11/1992 Price et al.
5,185,897 A 2/1993 Van Laanen ..... 5/455
5,203,270 A 4/1993 Price et al.
5,282,433 A 2/1994 Freermann et al. ..... 112/153
5,285,542 A 2/1994 West et al.
5,289,788 A 3/1994 Fukumoto ..... 112/121.12
5,341,755 A 8/1994 Kawasaki ..... 112/263
5,367,968 A 11/1994 Diaz ..... 112/262.3
5,373,798 A 12/1994 Price et al.
5,428,852 A 7/1995 Tenuta et al.
5,437,238 A 8/1995 Price et al.
5,475,881 A 12/1995 Higgins et al.
5,482,318 A * 1/1996 Sollars, Jr. ..... 280/743.1
5,483,909 A 1/1996 Nogueras ..... 112/475.04
5,501,164 A 3/1996 Porter et al. ..... 112/176
5,515,796 A 5/1996 Ogle et al. ..... 112/2.1
5,522,332 A 6/1996 Price et al.
5,529,004 A 6/1996 Porter et al. ..... 112/470.03
5,537,699 A 7/1996 Bonaddio et al. ..... 54/474
5,542,775 A 8/1996 Bechtoldt et al.
5,560,308 A 10/1996 Eto ..... 112/470.07
5,586,511 A 12/1996 Porter et al. ..... 112/2.1
5,617,802 A 4/1997 Cash ..... 112/117
5,645,002 A * 7/1997 Brocklehurst ..... 112/470.07
5,647,293 A 7/1997 Price et al. ..... 112/470.17
5,655,241 A 8/1997 Higgins et al. ..... 5/737
5,657,711 A 8/1997 Price et al.
5,701,623 A 12/1997 May
5,704,084 A 1/1998 Evans et al. ..... 5/710
5,729,851 A 3/1998 Hollander
5,743,202 A 4/1998 Price et al.
5,769,015 A 6/1998 Kato
5,778,811 A 7/1998 Gill et al.
5,782,190 A 7/1998 Porter et al. ..... 112/176
5,809,919 A 9/1998 Mitchell et al. ..... 112/470.07
5,816,177 A 10/1998 Brocklehurst ..... 112/470.05
5,865,135 A 2/1999 Price et al.
5,881,656 A 3/1999 Grant ..... 112/2.11
5,899,159 A 5/1999 Dasher et al.
5,908,004 A 6/1999 Porter et al.
5,915,319 A 6/1999 Price et al. ..... 112/470.16
5,918,560 A 7/1999 Dasher et al.
5,924,376 A 7/1999 Olewicz et al.
5,943,971 A 8/1999 Trickett et al. ..... 112/2.1
5,970,548 A 10/1999 Welch ..... 5/710
5,974,609 A 11/1999 Nunez et al.
5,983,814 A * 11/1999 Block ..... 112/2.1
6,000,352 A 12/1999 Porter et al. ..... 112/470.12
6,035,794 A 3/2000 Keeton
6,041,456 A 3/2000 Pharr
6,055,921 A 5/2000 Olewicz et al. ..... 112/475.07
6,088,858 A 7/2000 Juster et al.
6,125,488 A 10/2000 Vogland et al.
6,129,030 A 10/2000 Resta
6,202,579 B1 3/2001 Olewicz et al. ..... 112/2.1
6,209,468 B1 4/2001 Marcangelo et al. ... 112/475.06
6,263,532 B1 7/2001 Miller
6,276,009 B1 * 8/2001 Schrougham ..... 5/493
6,293,213 B1 9/2001 Block et al. ..... 112/470.5
6,295,481 B1 9/2001 Price
6,397,768 B1 6/2002 Dasher et al. ..... 112/2.11
6,408,773 B1 6/2002 Resta
6,530,335 B1 3/2003 Halfmann et al.
6,532,608 B1 3/2003 Schreiner ..... 5/497
6,574,815 B1 6/2003 Freeman et al. ..... 5/716
6,648,585 B1 11/2003 Block et al. ..... 414/759
6,715,173 B1 4/2004 Barman et al.
6,721,982 B1 4/2004 Freeman
6,760,935 B1 7/2004 Burton et al.
6,802,271 B1 10/2004 Oxley et al.
6,834,603 B1 12/2004 Price et al.
6,874,215 B1 4/2005 Flippin
6,889,622 B1 * 5/2005 Marcangelo ..... 112/475.06
2001/0032361 A1 10/2001 Schreiner ..... 5/497
2002/0050117 A1 5/2002 Dasher et al. ..... 53/117
2004/0129189 A1 7/2004 Oxley et al.

FOREIGN PATENT DOCUMENTS

DE 37 12493 A1 5/1987
EP 0264 618 A1 4/1988
EP 0 330 285 B1 2/1989
EP 0320468 A2 6/1989
EP 0 200 368 B1 10/1990
EP 0682135 11/1995
FR 1567893 9/1967
GB 1233945 6/1971
GB 1384073 2/1975
JP 7308465 11/1995
WO WO 92/12282 7/1992
WO WO 95/25194 9/1995
WO WO 02/065877 8/2002

OTHER PUBLICATIONS

Atlanta Attachment Company Ruffler brochure (AAC Model 1325) undated.

Photograph of Mattress, File Name 29477242, Dec. 14, 1999.
Photograph of Mattress, File Name 29477242, Dec. 14, 1999.
Photograph of Mattress, File Name 29477260.tif Aug. 9, 2000.
Photograph of Mattress, File Name 29477259.tif Aug. 9, 2000.
Photograph of Mattress, File Name 29477217, Dec. 14, 1999.
Photograph of Mattress, File Name 29477242, Dec. 14, 1999.
Photograph of Mattress, File Name 29477243, Aug. 9, 2000.
Photograph of Mattress, File Name 29477218, Aug. 9, 2000.
Photograph of Mattress, File Name 29477213, Aug. 9, 2000.
Photograph of Mattress, File Name 29477165, Aug. 9, 2000.
Photograph of Mattress, File Name 29477169, Aug. 9, 2000.
Photograph of CD labeled L&P—1331 Rufled Corner Prior Art 2003 (Porter).
Photograph of Mattress, File Name 800.EPS, Nov. 16, 1998.
Photograph of Mattress, File Name Stack9, EPS, Nov. 16, 1998.
Photograph of Mattress, File Name AUJ03341.EPS, May 1 1999.
Photograph of Mattress, File Name AUJ03337.EPS, May 1 1999.
Photograph of Mattress, File Name 3_4 W_PILLOWS.EPS, Sep. 6, 1999.
Photograph of Mattress, File Name 29477150.TIF, Aug. 9, 2000.
Photograph of Mattress, File Name 29477133.TIF, Aug. 9, 2000.
Photograph of Mattress, File Name 29477209.TIF, Aug. 9, 2000.
Photograph of Mattress, File Name 29477272.tif, Aug. 9, 2000.
Photograph of Mattress, File Name 29477254.tif, Aug. 9, 2000.
"Catalog of Automated Sewing Units, Components, and Other Labor-Saving Devices for the Sewing Industry", Atlanta Attachment Company, 1981, pp. 251-268.

* cited by examiner

SYSTEM AND METHOD OF FINISHING RUFFLED GUSSETS/BORDERS

CROSS REFERENCE TO RELATED APPLICATIONS

The present invention claims priority to U.S. Provisional Application Ser. No. 60/446,188, filed Feb. 10, 2003; to U.S. Provisional Application Ser. No. 60/448, 523, filed Feb. 20, 2003; and to U.S. Provisional Application Ser. No. 60/457, 517, filed Mar. 25, 2003.

FIELD OF THE INVENTION

The present invention generally relates to sewing mattress and other bedding components and in particular to system and method for forming and finishing ruffled mattress attachment gussets and foundation borders.

BACKGROUND OF THE INVENTION

In the manufacture of bedding materials such as pillow top mattresses and furniture cushions, in which an upper padded layer or layers is enclosed within a fabric panel that is attached by gusset to an accompanying pad or spring unit, the various components often are measured, cut and sewn to mattress or foundation panels in a series of separate operations performed at separate sewing stations. For example, in a pillow-top style mattress, a pillow-top is attached to a top panel of the mattress by a gusset that generally is formed from a folded band of material similar to the material from which the mattress tops are made. The gussets are often folded and sewn to the panel along the fold line of the gussets, and further generally have a flange that is attached along a lower edge portion, which flange subsequently will be stapled to a mattress frame. The upper edge portion of the gusset is then attached to the pillow top for attaching the pillow top pad to the mattress. The gusset further can have ruffles or pleats formed at its corners to allow the gusset to turn about the corners of the mattress to provide a more finished, rounded and smooth contour or appearance thereto.

Previously, the gusset forming and sewing process, including the formation of the ruffled corners thereof, typically was done manually, wherein the gusset material would be flanged and thereafter ruffled at its corners, and subsequently attached to the edges of a mattress panel. The pillow top would then be attached to the upper or free edge of the gusset. In addition to being extremely labor intensive, such manual sewing operations often require highly skilled workers and enable only limited production. Additionally, if the ruffles at the corners of the gussets were not made at the correct angles or an insufficient amount or size of ruffles were formed at the corners, the gusset corners would not have a smooth contour or appearance. Further, there was a risk that the gusset would not match the mattress panel to which it is to be sewn, thus requiring reworking or re-sewing of the gusset.

More recently, automated systems have been developed for forming and sewing attachment gussets having ruffled corners that are formed as the gussets are attached to a mattress panel. Such systems enable significant increases in production and greatly reduce the level of skill required by an operator and/or enable operators to run multiple machines at the same time, greatly improving the production of the mattress panels with ruffled gussets. One draw-back that has been seen with such equipment, however, is that when the gussets for pillowtop type mattresses are folded in half and sewn along the fold line to the mattress panel, the increased thickness in the gusset material creates problems in sewing the gusset to the mattress panel. This is especially a problem when a thick gusset material is used and doubled when folded over. In addition, for pillow-top mattresses, it is important that there be sufficient ruffles formed in the gusset to enable the bottom or lower edge portion of the gusset to be attached in a substantially flat lying arrangement with the border or base of the mattress. For extremely thick materials and for pillow-top mattresses where there is an offset between the upper and lower portions of the gusset, however, it is difficult to form a sufficient number of ruffles that are small enough to enable the lower portion of the gusset to lie flat when attached to the mattress, while at the same time enable the upper portion to have a substantially upstanding "cupped" attitude for the attachment of the pillow-top thereto.

Still further, such automated systems often have folders for directing a portion of the gusset material over the remainder of the gusset material to form the fold, as desired. Such folders are, however, typically limited to a narrow range of widths or sizes of gusset materials that can be folded thereover and further limit the extent or amount of folding, and thus the amount of offset that can be created in the gussets. As a result, it is often necessary when running different size gusset materials that the folders must be changed out, thus requiring the operators to have multiple different size folders on hand to accommodate such changes in the gusset materials. Still further, the thickness of folded gusset materials often prevents the area or region where the leading and trailing ends of the gussets overlap to lay substantially flat when finished. As a result, operators must, at times, remove lines of stitching from the ends of the gusset after sewing to the mattress panel, trim and fold back the plies of gusset material at the trailing end of the gusset, and thereafter fold or tuck the end of the trailing end of the gusset back under the leading end for sewing.

Similarly, while automated systems have been developed for measuring, cutting and forming borders for attaching to a foundation frame such as a mattress or box springs, a drawback of such systems is, however, that they generally are limited in the type and number of sewing operations that can be performed to form foundation borders. In addition, it recently has become more desirable to fashion foundation borders with mitered corners to form "Continental Foundation Borders," wherein a portion of the border will be folded over and laid flat on top of a foundation panel to which the border is attached, with the corners of the border being mitered and sewn so as to form a flat, finished and substantially even appearance with the foundation panel top. Conventional automated border sewing workstations generally are not designed to form such mitered corners. As a consequence, the mitered corners typically will be formed manually by an operator who must measure, cut and notch mitered corners in a plain foundation border to form a Continental foundation border. The border thereafter must be subjected to a subsequent, later sewing operation to attach the notched portions of the Continental foundation border to a foundation panel, which in turn must later be sewn to a foundation frame in order to form a foundation having a Continental foundation border. Such additional measuring, cutting and sewing operations further increase the time, labor and expense involved in the manufacture of such Continental foundation borders and thus the subsequent foundations or mattresses to which they are attached.

Accordingly, it can be seen that there is a need for a system and method of producing pillowtop attachment gussets and foundation borders for bedding materials having ruffled corners and which enable their ends to be closed and sewn in a flat configuration about a mattress or foundation panel, which addresses the foregoing and other related and unrelated problems in the art.

SUMMARY OF THE INVENTION

Briefly described, the present invention generally relates to a system for forming and attaching pillowtop attachment gussets and/or foundation borders about the periphery of mattress or foundation panels with ruffles or pleats formed in the gussets or borders as they are sewn about the corners of their associated panels. The attachment system of the present invention generally includes a sewing station having a sewing head defining a sewing area or zone at which a gusset or border material is received and sewn about the peripheral edges of a panel for a mattress or foundation.

In one embodiment of the attachment system of the present invention, a substantially continuous length of untensioned gusset or border material will be fed to the sewing station by a pre-feed system. The pre-feed system generally will include a series of pre-feed rolls, with at least one set or pair of the pre-feed rolls driven by a motor controlled by the system control of the gusset attachment system. The pre-feed rolls will pull a length of gusset or border material from the supply, with a slack portion of gusset or border material being monitored by a sensor. The sensor signals the system control to control the driving of the pre-feed rollers to feed more gusset or border material as needed to maintain a sufficient supply or length for sewing to a desired size panel. Alternatively, the gusset or border material can be fed through a pre-flange station for applying a flanging material thereto, prior to being fed into the sewing station.

The gusset or border material initially is fed into a folder or guide assembly having a series of spaced folder plates that define a passage or slot through which the gusset or border material is fed. Guides can be adjusted laterally across the plates for creating a fold of a desired size or width in the gusset material and/or for adjusting the position of the gusset or border material with respect to the sewing needle. The gusset material thus is folded as needed to enable formation of pillowtop mattresses of different or varying thicknesses, including the Euro-box-top type pillowtop mattresses. The folder assembly itself further generally is adjustable with respect to the sewing needle and typically is attached to a pivotable mounting assembly so that the folder assembly can be moved away from the sewing area to enable easy access for cutting the gusset or border material.

A ruffler mechanism is mounted upstream from the sewing area and generally includes a ruffler foot or blade and a drive for moving the foot into engagement with the border or gusset material. The operation of the ruffler can be automatically controlled by the system control or can be operated manually by the operator. As the ruffler blade engages the gusset or border material, it forms a series of folds, pleats, or ruffles in the gusset or border material while the operator rotates the panel for sewing the gusset or border material about the corner of the panel. In addition, a tension mechanism generally is positioned upstream from the sewing area, and includes an actuator for moving a tension element, such as a foot or pad, into engagement with the panel for exerting a drag or tension on the panel during sewing. As a corner of the panel being sewn approaches the sewing area and the ruffler is actuated, the tension mechanism generally is automatically deactivated to enable the pivoting movement of the panel for sewing about the corners thereof. Upon completion of a sewing operation, the operator will pivot the folder assembly and ruffler mechanism away from the sewing area for severing the gusset or border material from the length of material being supplied, after which the operator can fold under the remaining, unsewn portion of gusset or border material and attach it to the panel.

Various objects, features and advantages of the present invention will become apparent to those skilled in the art upon reading the following detailed description, when taken in conjunction with the accompanying drawings.

DESCRIPTION OF THE INVENTION

Figure 1A:
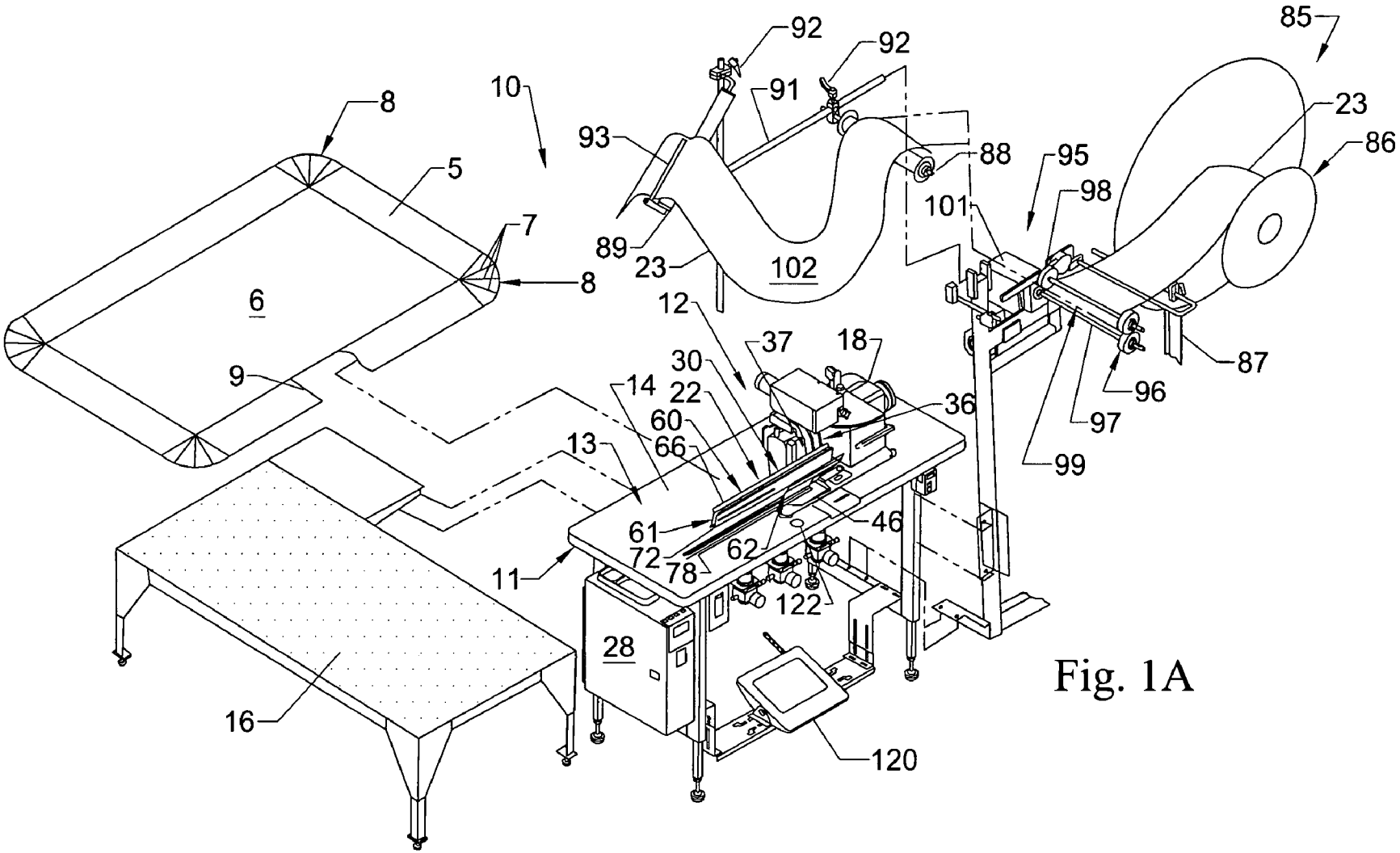
FIG. 1A illustrates the attachment system of the present invention.
Figure 1B:
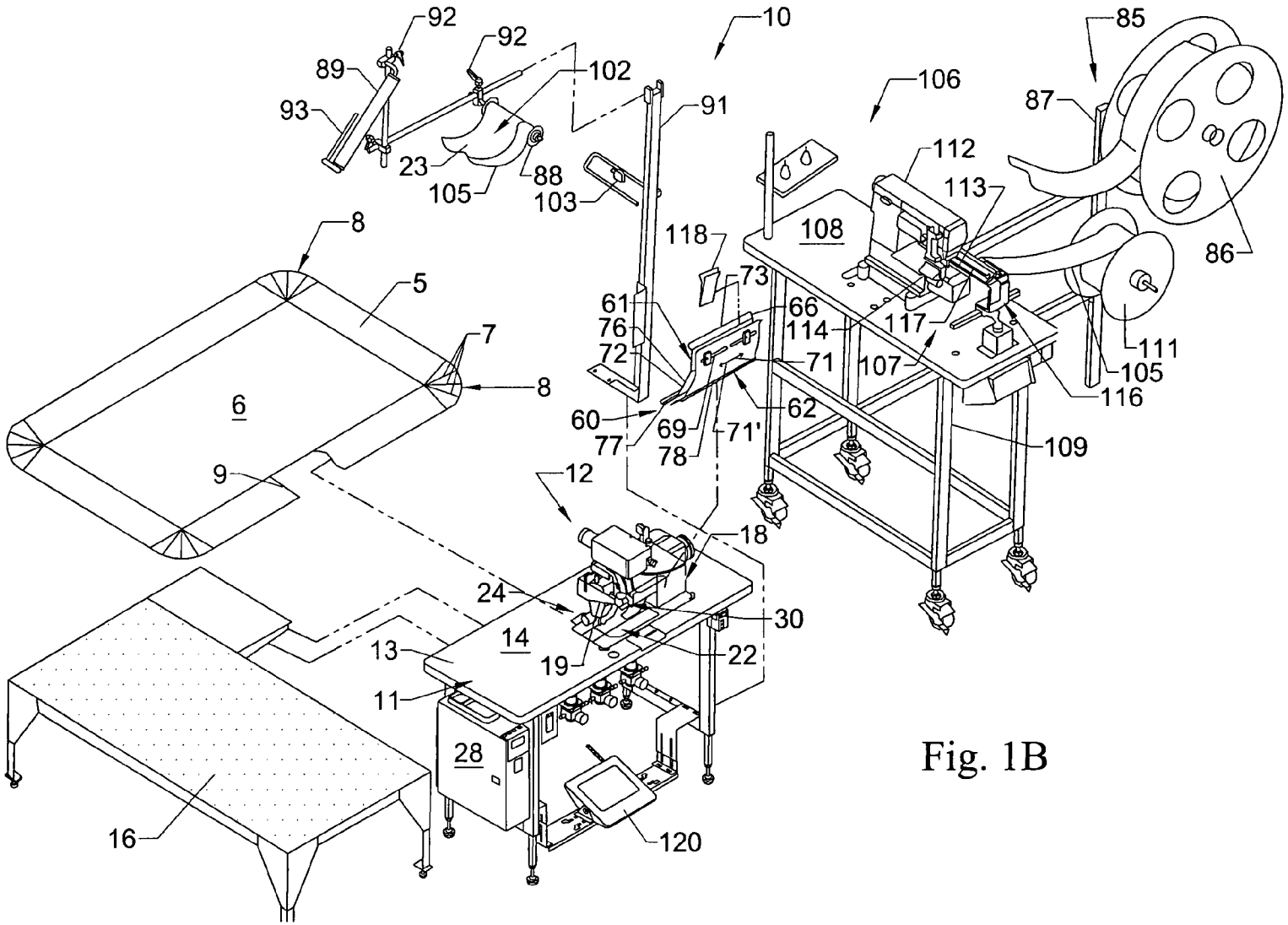
FIG. 1B is an exploded perspective view illustrating an additional alternative arrangement of the attachment system of the present invention, including a pre-flanging station.

Referring now to the drawings in which like numerals indicate like parts throughout the several views, FIGS. 1A–1B illustrate alternative arrangements of the method and attachment system 10 for forming and attaching finished, ruffled gussets and borders to a work piece such as a mattress or foundation panel or similar article according to the present invention. In a first example embodiment of the present invention, a pillowtop attachment gusset 5 is formed and attached to a work piece such as a mattress panel 6 using the attachment system 10, with ruffles or pleats 7 being formed at the corner portion 8 of the gusset 5 as the gusset 5 is attached to its mattress panel 6, and with the ends 9 of the gusset 5 finished in a substantially flat lying configuration. The gusset attachment system of the present invention can be used as part of, or in conjunction with, an automatic gusset ruffler and attachment system, such as disclosed in U.S. patent application Ser. No. 10/219,837 filed Aug. 15, 2002, the disclosure of which is incorporated herein by reference, or can be used as part of a separate, stand-alone work station.

The attachment system 10 of the present invention is illustrated generally in FIGS. 1A–4B, attached hereto. As illustrated in FIGS. 1A–1B, the attachment system 10 generally includes a worktable 11, with a sewing unit or station 12 mounted on the worktable. The worktable 11 includes an upper support surface 13 having an open support space or area 14 adjacent the sewing station or unit 12 in which a mattress panel 6 generally is supported during the sewing of an attachment gusset 5 thereto. The worktable 11 can be of a limited size, such as in situations where the attachment system 10 is used as a stand-alone workstation, or can be of a larger size sufficient to support fully a desired size mattress panel 6 thereon. In addition, as shown in FIGS. 1A–1B, the worktable 11 can include an air table 16 such as disclosed and described in U.S. patent application Ser. No. 10/219,837, filed Aug. 15, 2002 and incorporated herein by reference, that can be mounted or attached as a separate unit to the worktable to expand the support surface 13 thereof, depending on the use and/or configuration of the attachment system 10.

Figure 2:
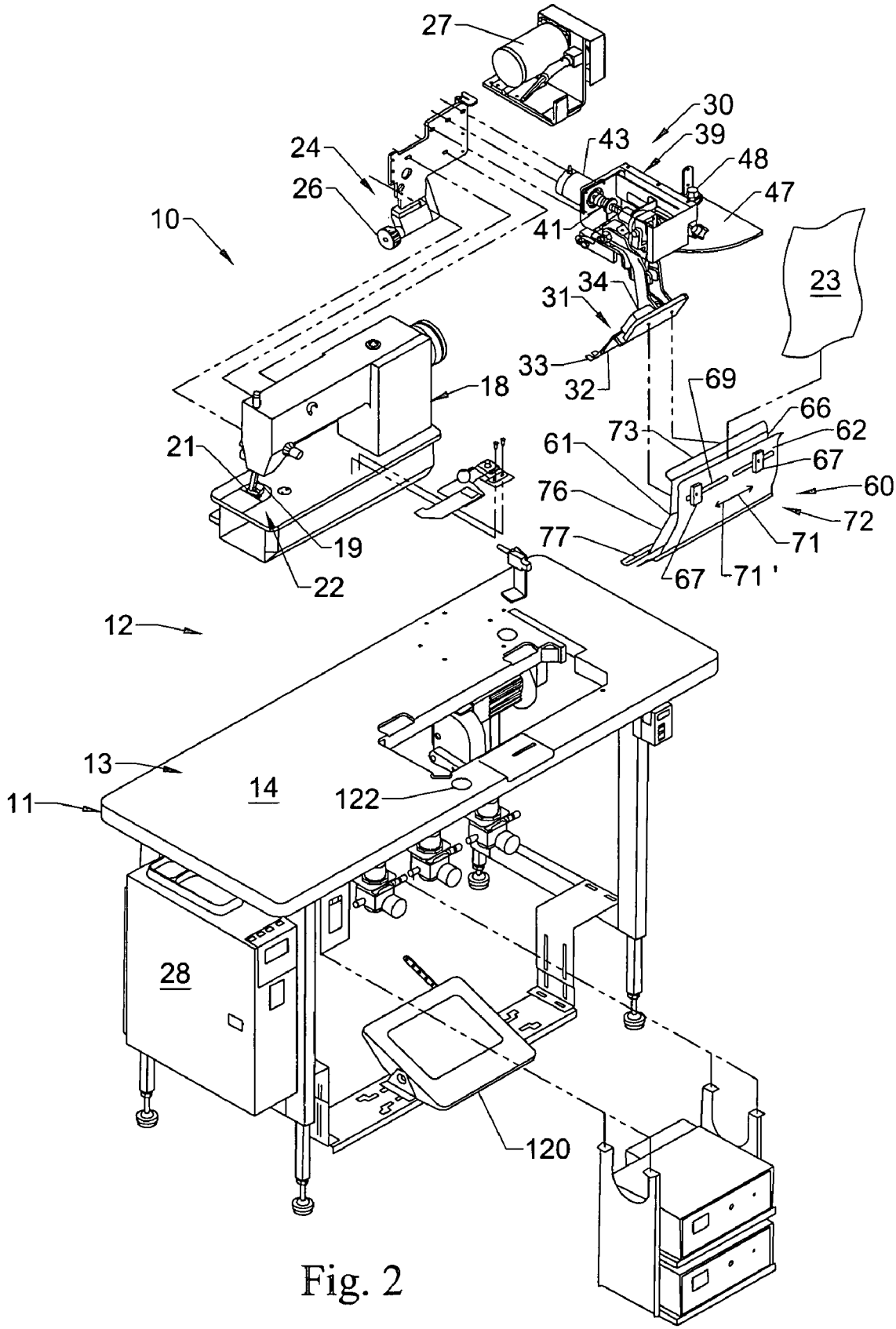
FIG. 2 is an exploded perspective view illustrating the sewing station of the attachment system of FIGS. 1A and 1B.

As illustrated in FIGS. 1A–2, the sewing station or unit 12 generally includes a high speed chainstitch or lock-stitch sewing head 18, such as a Mitsubishi LS2-2210 lockstitch machine or a Juki MH9816 chainstitch machine, and typically includes at least one sewing needle 19 and a trimmer (not shown) for trimming the thread chain from the gusset following sewing. The sewing head further includes a presser foot 21 (FIG. 2), which, together with the needle 19, defines a sewing area or zone 22 of the sewing station in which a length of gusset material 23 is received, ruffled, and attached to its mattress panel to form a finished pillowtop attachment gusset. Additionally, a puller assembly 24 generally is mounted to the sewing head behind the needle and includes a puller wheel or roller 26 driven by a motor 27. Additionally, the attachment system 10 includes a system control 28 for controlling the operation of the attachment system, including the operation of the sewing station for forming and attaching the gussets and/or borders to their associated panels. The system control generally is mounted beneath the worktable and sewing station that can be programmed with various sewing instructions or control commands such as the number of ruffles to be applied, as well as monitoring and controlling various aspects of the gusset attachment sewing operation.

Figure 3:
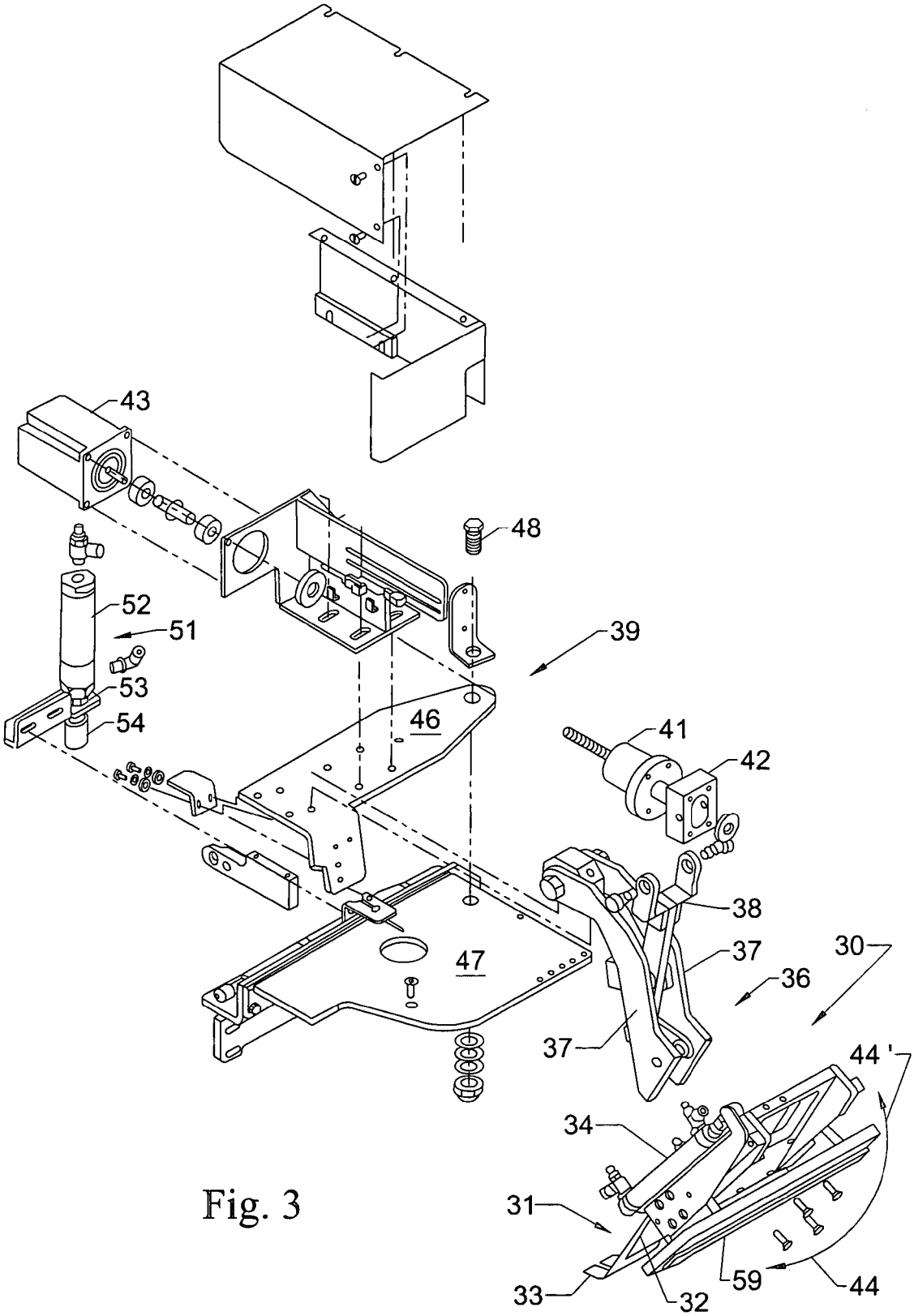
FIG. 3 is an exploded perspective view of the ruffler assembly of the attachment system of FIGS. 1A and 1B.

The sewing station 12 further generally includes a ruffler mechanism 30 illustrated in greater detail in FIGS. 2 and 3. The ruffler mechanism generally includes a ruffler foot or blade 31 and a body 32 that terminates in a hooked or slanted lower end 33. The foot or blade 31 generally is formed from a high strength material such as aluminum, steel, or similar metals, or plastic or other synthetic or composite materials. The body 32 further typically has a substantially smooth surface with a reduced or lower coefficient of friction so that as the ruffler blade engages the gusset material 23, it will pass over the gusset material without picking or scratching the material. The ruffler blade 31 is mounted to an actuator 34, which typically includes a pneumatic or hydraulic cylinder, although other types of actuators, such as a reversible, variable speed servomotor or stepper motor also can be used. The actuator 34 moves the ruffler blade 31 between retracted and engaging positions so as to engage and form the pleats or ruffles 7 (FIGS. 1A and 1B) in the gusset material 23, as the gusset material is sewn around the corners of its mattress panel 6. Typically, the ruffler mechanism will be actuated to form a desired number of pleats or ruffles in the gusset material as it is sewn to its mattress panel. The number and size of the pleats or ruffles being formed generally depends upon the thickness or size of the mattress and attachment gusset, and/or the size of the mattress pillowtop to which the gusset will be attached. When complete, the attachment gusset will be securely attached to its associated mattress panel, in a substantially flat lying configuration along the sides and corners of the mattress panel.

As shown in FIGS. 2 and 3, the ruffler mechanism 30 is mounted on a pivot assembly 36. The pivot assembly generally includes one or more pivot arms 37 that support the ruffler mechanism 30 and a drive yoke or link 38, typically mounted between the pivot arms 37, which connects the pivot arms to a drive assembly 39. The drive assembly 39 includes a ball screw 41 attached at one end to a mounting block 42 to which the drive link 48 is connected at its opposite end to an actuator 43. The actuator 43 typically is a reversible, variable speed motor, such as a servomotor, stepper motor, or similar actuator, which drives the ball screw 41 in response to commands from the system control of the attachment system 10 of the present invention so as to cause the pivot assembly 36, and thus the ruffler mechanism 30 being carried therewith, to be pivoted between a lowered, engaging position and a raised, non-engaging position in the direction of arrows 44 and 44' for moving the ruffler mechanism toward and away from the sewing area or zone 22 (FIG. 2). The pivot assembly 36 is mounted to and supported by a pivot plate 46 (FIG. 3) that is pivotally attached to a base or support plate 47 by a hinge pin 48 such as a bolt, screw or similar fastener, as illustrated in FIG. 3. Thus, in its raised, non-engaging position, the ruffler mechanism 30 further can be pivoted or swung away from the sewing zone to facilitate access to the gusset material 23 and mattress panel by the operator without interference for the finishing of the attachment gusset sewing operation.

As further illustrated in FIG. 3, a tension mechanism 51 generally is mounted to the pivot plate 46 adjacent the ruffler mechanism 30. The tension mechanism includes an air cylinder 52, which can be a pneumatic or hydraulic cylinder or other type of actuator and which includes an extensible rod 53 as moveable into and out of the cylinder as the cylinder is actuated by the control system of the gusset attachment system 10 of the present invention. A tension element such as a pad, foot or bumper 54, typically made from relatively soft material such as rubber, plastic, or foamed materials, is attached with the free end of the rod 53. When the cylinder is actuated, it extends its cylinder rod 53 downwardly so that the pad 54 engages the mattress panel along or adjacent its peripheral edge against the base plate 47. As a result, a drag or tension force is exerted on the mattress panel so as to ensure that the edges of the mattress panel remain flat and under tension as the gusset material is sewn thereabout to avoid gapping or bunching of the gusset material and/or mattress panel as they are sewn together.

Figure 4A:
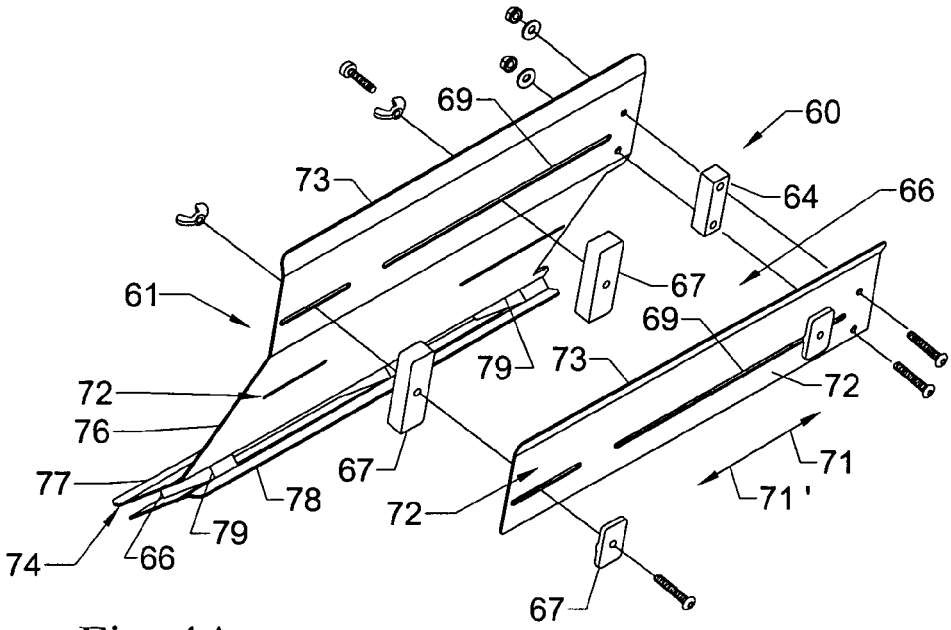
FIGS. 4A and 4B are exploded perspective views illustrating various embodiments of the folder or guide assembly of the present invention.
Figure 4B:
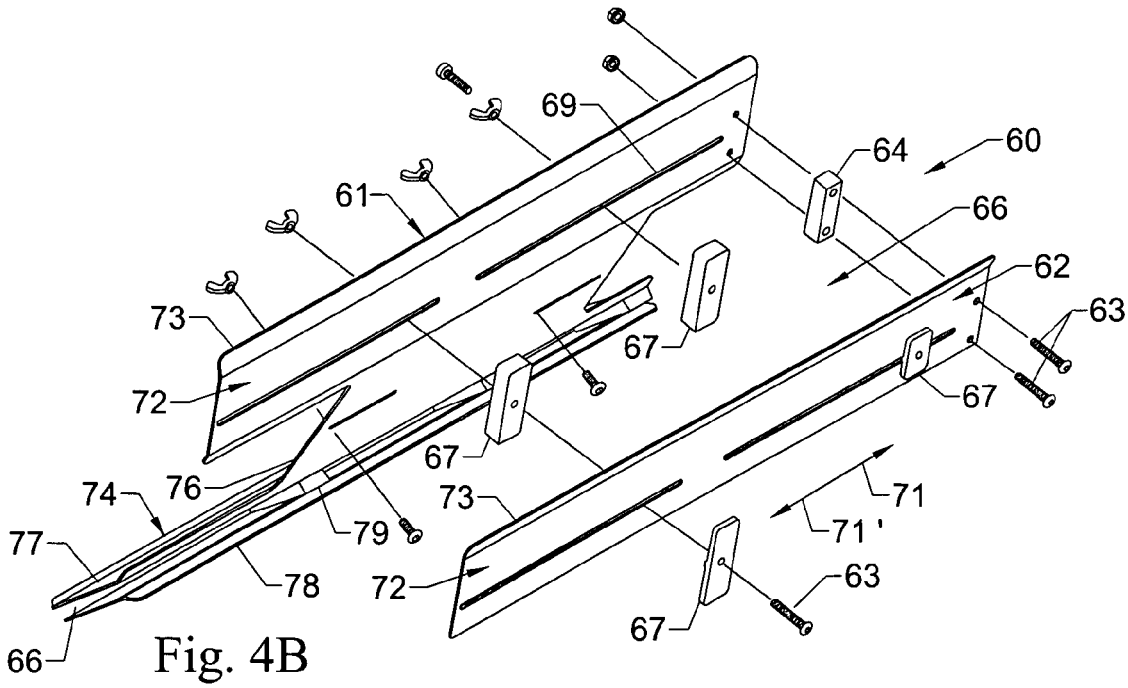

As further illustrated in FIGS. 1A–2, a folder or guide assembly 60 generally is positioned slightly upstream from the sewing zone 22 and ruffler mechanism 30 of the sewing station 12 in a position so as to receive and fold the gusset material 23 (FIGS. 1A and 1B) as it is fed into the sewing zone for attachment to a mattress panel 6. The folder or guide assembly further generally is adjustably mounted to the ruffler mechanism or a support therefor, such as plate 59 shown in FIG. 3, to enable movement of the folder or guide assembly with respect to the needle of the sewing station to adjust the position or alignment of the location or point along which gusset material is sewn to its panel. FIGS. 4A and 4B generally illustrate example embodiments of the folder assembly 60. It further will be understood by those skilled in the art that various other types of folder assemblies or systems for receiving, folding gusset material to a desired extent or amount, and guiding the folded gusset material into the sewing zone, also can be used.

As illustrated in FIGS. 4A and 4B, the folder assembly 60 generally includes a series of folder or guide plates, such as 61 and 62, attached together with bolts, screws or similar fasteners 63. Spacer blocks 64 generally are received between the folder plates 61 and 62 so as to set or fix the spacing between the folder plates by a desired amount so as to define a passage 66 (FIGS. 1A–2) through which the gusset material is received and guided. In addition, as further illustrated in FIGS. 4A and 4B, guide blocks 67 typically are positioned between the folder plates 61 and 62. The guide blocks are moveable laterally across the passage 66 between the folder plates as their fasteners 68 are moved or slid along guide slots 69 in the direction of arrows 71 and 71' (FIG. 2), so as to adjust the lateral size of the passage between the folder plates to help set or determine the extent or amount by which the gusset material is folded as it passes through the folder assembly as needed depending upon the size or thickness of the pillowtop to be attached to the mattress by the gusset. For example, for Euro-box-top or similar type pillowtop mattresses having a relatively thick pillowtop with a width or thickness of 2–3 inches, the fold in the gusset material can be adjusted accordingly to adjust the amount of overlap between the upper and lower edge portions of the gusset as it is sewn to its mattress panel to provide for sufficient "cupping" of the gusset at the corners thereof as needed to accommodate varying size pillowtops.

Additionally, each of the folder plates 61 and 62 (FIGS. 4A–4B) generally will be formed from a material such as aluminum, steel, or similar metal materials having a polished, smooth surface, or can be formed from various plastic, composite or synthetic materials having smooth, non-stick surfaces to enable to the gusset material to slide therethrough without substantial friction or interference that would tend to create a drag on the gusset material as it is pulled through the folder by the sewing head. The folder plates 61 and 62 each generally include a body portion 72, with upper, outwardly angled flange portions 73 to help guide the gusset material 23 (FIGS. 1A and 1B) into the passage formed therebetween. At least one of the folder plates, such as plate 61 as illustrated in FIGS. 4A and 4B, further can include an angled lower body portion 74 that typically can include a first angled section 76 and a second angled section 77 that extend downwardly and forwardly toward the sewing zone of the sewing station. The second folder plate 62 can be formed with a substantially mirror construction such as illustrated in FIGS. 1B and 2, or one or more additional guide plates, such as indicated at 78 in FIGS. 4A and 4B, that are mounted opposite one or more of the lower sections 77 and/or 76 by spacer or guide blocks 79, which maintain the spacing between the folder plates as required for the passage 66 and enable adjustment of the width of the passages as needed to adjust the feeding of the gusset material with respect to the needle and the amount of folding or overlap between the upper and lower edge portions or the gusset material.

As illustrated in FIGS. 1A and 1B, the gusset material 23 generally is received at the sewing station from a downstream supply 85 and is fed through the folder or guide assembly 60 into the sewing area for attachment of the gusset material 23 about the peripheral edges of mattress panel 6. FIGS. 1A and 1B illustrate alternative arrangements or embodiments for the feeding of the gusset material 23 from its downstream supply 85. In both embodiments, the supply 85 of gusset material 23 typically includes a reel or roll 86 of gusset material mounted on a frame member 87 so that the gusset material 23 can be pulled or fed progressively from its supply reel 86. The gusset material will be fed from its supply reel over a series of idler guide rolls 88 and 89, typically mounted on an adjustable framework 91 by adjustable mountings 92. The guide rolls thus can be adjusted to a desired height and desired angle or orientation for feeding the gusset material into the folder assembly of the sewing station 12, typically from an overhead position as shown in FIG. 1A. In addition, a guide bar 93 can be mounted adjacent the downstream idler guide roll 89 to help hold the gusset material as it is turned and passes over its idler guide roll 89 and fed downwardly into the folder assembly to ensure that the gusset material will not slide or shift off of the idler guide roll 89.

In the arrangement or embodiment of the attachment system 10 of the present invention illustrated in FIG. 1A, a pre-feed assembly 95 generally is positioned between the gusset material supply 85 and the sewing station 12 for pulling and feeding a substantially continuous supply of the gusset material 23 from its supply reel 86 into the sewing station so that the gusset material is fed to the sewing station with any tension thereon due to the weight and/or pulling of the material from its supply reel being minimized. As illustrated in FIG. 1A, the pre-feed assembly 95 generally includes a series of pre-feed rollers 96 typically arranged in pairs or sets of rollers, including a lower pair 97 and an upper pair 98 defining an engagement gap 99 through which the gusset material 23 is passed. A drive motor 101 generally is linked to at least one pair of the pre-feed rolls 96, such as the lower pair 97. The driving of the pre-feed rolls thus causes the gusset material to be pulled from its supply reel 86 and fed upwardly over the idler guide rolls 88 and 89.

As indicated in FIG. 1A, a slack portion 102 of the gusset material 23 generally is formed between the guide rolls 88 and 89, wherein the gusset material drops downwardly between the guide rolls by a desired length or amount. A sensor 103, typically a photoelectric eye or similar sensor, generally is mounted to the support frame 91 that supports the guide rolls and pre-feed assembly and is directed toward the slack portion 102 of the gusset material formed between the guide rolls. The sensor monitors the slack portion and signals the system control 27 of the attachment system 10 when the slack portion is reduced or taken up above a threshold or minimum level, i.e., as the sensor 103 is uncovered. In response, the system control operates the drive motor 101 to drive the pre-feed rolls for feeding additional gusset material to maintain the slack portion at a desired level sufficient to form an attachment gusset of a desired size.

FIG. 1B illustrates an alternative arrangement or embodiment of the gusset attachment system 10 in which a flanging material 105 is attached to the gusset material 23 at a downstream, pre-flanging workstation 106. The pre-flanging station 106 can be connected directly to the sewing station 12, or can be a free-standing module or unit, such as generally illustrated in FIG. 1B. The pre-flanging station generally includes a table 107, having a tabletop 108 mounted on a frame 109. In this embodiment, the frame 87 supporting the supply reel 86 of gusset material generally will be attached to the frame 109 of the pre-flanging station 106 and further generally will support a supply reel 111 of the flanging material 105. The pre-flanging station further generally includes a sewing head 112, which typically includes a chainstitch or lockstitch type sewing head having at least one sewing needle 113 and further typically including a puller assembly 114 for pulling the flange and gusset material through the pre-flanging station 106. A folder 116 further generally is mounted upstream of the sewing head and includes folder plates 117 defining a guide passage through which the flanging material 105 and gusset material 23 are received and guided in a desired alignment for attachment of the flanging material to the gusset material.

After the flanging material has been attached to the gusset material, the combined pre-flanged gusset material generally will be fed over the guide rolls 88 and 89 and into the folder assembly 60 for attachment of the pre-flanged gusset material to its mattress panel 6. As shown in FIG. 1B, the pre-flanged gusset material can be fed into and drawn through the sewing station 12 by the operation of the pre-flange station and the sewing head 18 and its puller assembly 23, with the pre-flange station also being controlled to perform the slack generation function of the pre-feed assembly 95 as illustrated in FIG. 1A. Alternatively, a pre-feed assembly also can be used between the pre-flange station 106 (FIG. 1B) and sewing station 12 to reduce or minimize the tension on the pre-flanged gusset material as it is fed into the sewing station. A flange guide 118 (FIG. 1B) also can be mounted adjacent a top edge of the folder plates 61 and 62 for causing the flanging material 105 attached to the gusset material 23 to be folded over against the gusset material and out of the way as the pre-flanged gusset material is fed into the sewing zone.

During operation of the attachment system 10 as illustrated in FIGS. 1A–2, the operator will manipulate or control the rate of sewing via a foot pedal or similar control 120 for sewing the gusset 5 to the mattress panel 6 along a folded edge of the gusset with the amount of overlap between the upper and lower edges of the gusset, i.e., the amount of folding of the gusset, being adjusted by the adjustment of the guide blocks of the folder 60. The gusset material is fed either with or without a flanging material 105 (FIG. 1B) being previously attached thereto, from an overhead position, passed downwardly into the guide passage 66 of the folder or guide assembly 60. The gusset material generally is folded to a desired extent or amount as needed, depending upon the size of the pillowtop to be attached to the mattress panel, as it passes through the folder assembly.

The operator sews the gusset material to the mattress panel with the folded edge of the gusset material being substantially attached to the outer peripheral edges of the mattress panel. As a corner of the mattress panel approaches the sewing needle, a sensor 122, generally mounted in the table 11, detects the passage, and thus the approach of the corner of the mattress panel toward the sewing zone 22 of the sewing station 12 and sends a signal to the system control 27 of the attachment system 10. In response, after a pre-set delay, typically based on a pre-programmed number of stitches required to finish sewing the gusset material to a desired point adjacent the corner of the mattress after detection of the corner, the rate or operation by the sewing head will be slowed and the ruffler mechanism 30 actuated as the operator begins to return or rotate the mattress panel about the sewing needle 19. Alternatively, the operator can manually stop or slow the operation of the sewing head and actuate the ruffler mechanism.

As the operator rotates the mattress panel and continues to sew the attachment gusset about the corner of the mattress panel, the ruffler mechanism engages and forms a series or ruffles or pleats in the gusset material. As a result the attachment gusset is provided with a substantially rounded shape or configuration as it is attached about the corner of the mattress panel, with the gusset material thus left in a substantially flat-lying arrangement about the corners of the mattress, as indicated in FIGS. 1A and 1B. The ruffler mechanism 30 can be automatically controlled or actuated by the system control 27, or can be manually actuated as needed by the operator to form a desired number and depth of pleats or ruffles about the corner of the mattress. The number and depth of the ruffles generally varies depending upon the size of the mattress panel to which the attachment gusset is being sewn, and to enable "cupping" of the upper portion of the gusset about the corners thereof.

At the same time the ruffler mechanism is being engaged, the tension mechanism 51 (FIG. 3) is controlled by the system control so as to retract its cylinder and thus the bumper or pad 54 (FIG. 3) out of engagement with the mattress panel to enable the mattress panel to be freely rotated about its corner without interference or drag thereon. Once the pillowtop attachment gusset 5 (FIGS. 1A–1B) has been sewn about the corner of the mattress panel, the ruffler mechanism 30 is deactivated, while at the same time, the tension mechanism 51 (FIG. 3) is reactivated so that its bumper or pad is moved into engagement with the mattress panel to create and apply a tension or drag thereto, as the operator continues to sew along the next peripheral edge of the mattress panel.

After the attachment gusset has been sewn about all four corners of the mattress panel and the initially sewn portion of the mattress panel approaches the sewing station, such as indicated in FIG. 1B, the operator generally will stop the sewing operation and lift and pivot the folder assembly 60 and ruffler mechanism 30 upwardly and rearwardly away from the sewing area or zone so as to provide easy access to the gusset material at the sewing zone, without interference from the folder assembly and ruffler mechanism. The operator will sever or trim the gusset material as close as possible to the initially sewn edge of the attachment gusset and generally will fold the remaining, unattached portion or edges of the attachment gusset material under itself. The operator then can finish sewing the gusset mattress panel to complete the attachment of the pillowtop attachment gusset to its mattress panel.

DISCUSSION OF ADDITIONAL EMBODIMENT

Figure 5:
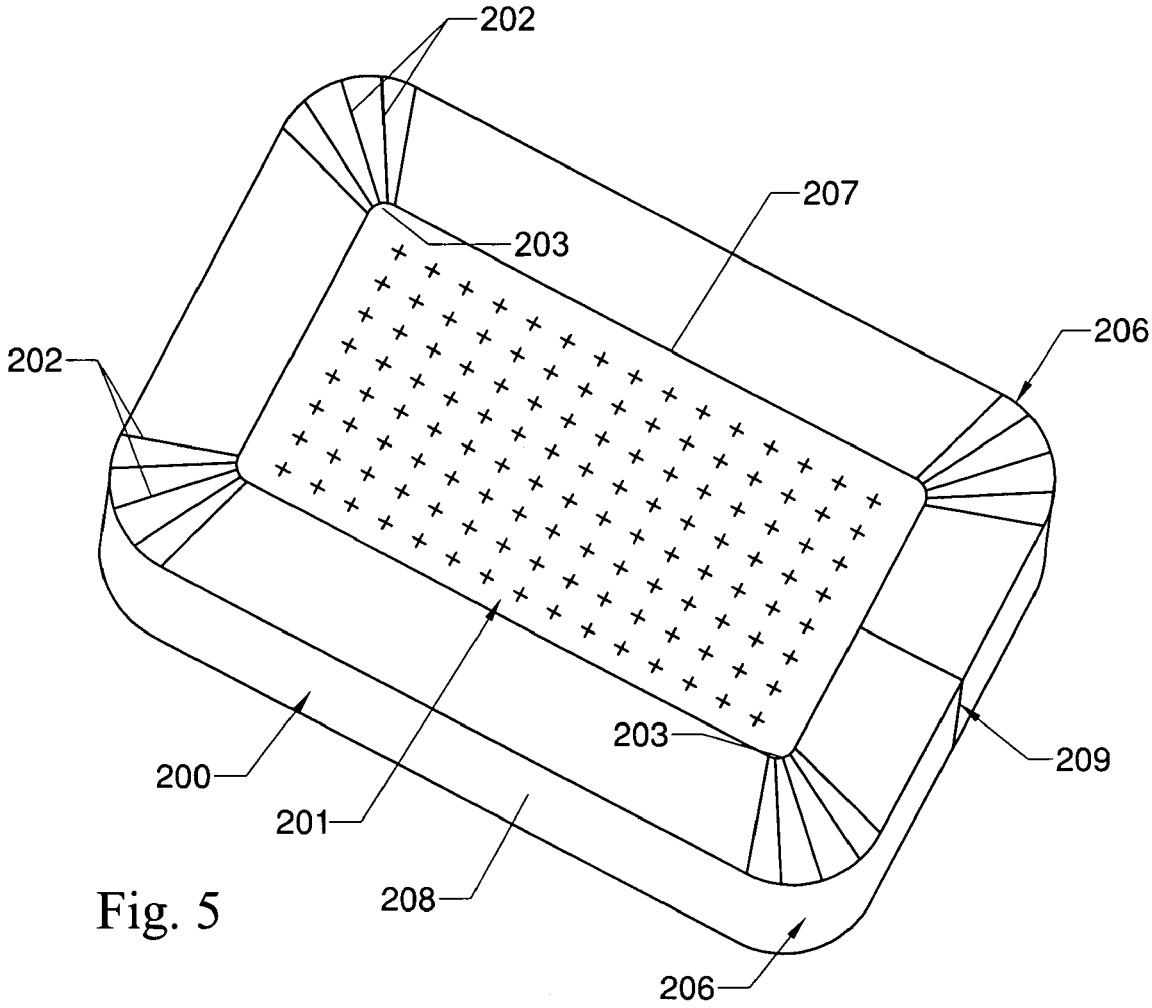
FIG. 5 is a perspective illustration of a Continental foundation border formed according to another embodiment of the present invention.

In an additional embodiment of the present invention, the attachment system 10 (FIG. 1A) also can be used for the formation and sewing of a foundation border 200 to a work piece such as a panel 201, as illustrated in FIG. 5, such as for a foundation for a mattress, box springs and/or similar bedding materials or articles. In this embodiment, the attachment system generally can be programmed to form borders 200 of different sizes and configurations for use with different types or sizes of foundations, including formation of "Continental" style foundation borders 200 having a series of ruffles or pleats 202 formed about portions of the border at which the border is attached to corner portions 203 of the panel 201 to thus form smooth, rounded corners 206 for fitting closely about a foundation frame. The attachment system 10 typically will include the system or arrangement as illustrated in FIG. 1A, including the sewing station 12 with a pre-feed assembly 95 upstream therefrom for feeding a supply of border material to the sewing station. It will, however, be understood that the border material can be pre-flanged, such as illustrated in FIG. 1B.

The border material further can be substantially the same as the material used for forming an attachment gusset for pillowtops mattresses, although the border material that typically will be of a greater width or size. The border material thus will have a desired width sufficient to enable a first or upper portion 207 (FIG. 5) of the border 200 to be folded over and laid flat on top of the panel 201 as shown in FIG. 5, while a second or lower portion 208 of the border is extended downwardly therefrom in a direction substantially perpendicular to the panel and upper portion of the border.

Prior to initiating the formation and sewing operation, the operator typically will adjust the portion of the folder or guide assembly 60 (FIG. 1A) for receiving and aligning the border as needed for sewing. The operator can adjust the width or spacing between the folder plates 61 and 62 to accommodate varying thicknesses of the border material passing therethrough, and further generally will adjust the position of guide blocks 64 (FIGS. 4A and 4B) to set the width and alignment of the passage 66 through the folder assembly, and thus the feeding of the border material, with respect to the sewing needle of the sewing station. In this embodiment, the border material is not necessarily folded over for attachment to its panel, but generally will be moved or adjusted laterally with respect to the sewing needle to adjust the amount of spacing from the first and second edge 210, 211 (FIG. 5) of the border material of the location or position 212 along which the border is sewn to the panel. For example, depending upon the amount of overlap of the upper portion of the border needed or desired on top of the foundation frame to which the border and panel will later be attached, the border, such as a "Continental" foundation borer, may be sewn to its panel at a location spaced inwardly from its first edge 210 by a desired spacing, or can be sewn along approximately a centerline of the border, or along any other position or location as needed.

After the operator has adjusted the position of the border material with respect to the sewing needle as needed to provide the desired amount of overlap by the upper portion of the border, the operator can begin a sewing operation. The border material will be fed, typically via a pre-feed assembly or system 95 (FIG. 1A), into and through the folder or guide assembly 60 for sewing to the mattress panel. As a corner of the panel approaches a sewing needle, the ruffler mechanism 30 generally will be engaged either manually by the operator or automatically by the system control of the attachment system 10. As discussed above, upon actuation, the ruffler blade 31 is extended and retracted by its actuator 34 being moved between engaging and non-engaging positions. In its engaging position, the ruffler blade will engage the border material to form folds, ruffles or pleats 202 (FIG. 5) in the border material as the operator rotates the panel 201 and continues to sew the border material about the corner 203 of the panel.

The extent or depth of the ruffles or pleats formed in each border as it is sewn about the corner of its associated panel, as well as the number of pleats or ruffles formed, can vary, but generally will be sufficient to provide the desired amount of overlap radius for the border and panel when the panel is applied to a foundation frame; and/or to enable "cupping" of the lower portion of the border so as to cause it to stand-up or otherwise extend substantially perpendicularly to the upper portion. Such cupping enables the corner portion 206 of the border to closely fit about the corners of the foundation frame to which the panel and borders are later applied.

For "Continental" style foundation borders, the border material further typically will run through the sewing station in a reversed or upside down (i.e., turned over) orientation as it is fed through the folder assembly and sewing zone. The ruffler mechanism thus generally will form the ruffles in the wider of the two sections of border material being sewn to form a desired overlap radius and cupping of the border material when the completed Continental foundation border is turned over or inverted for application to a foundation frame. Thus, for example, instead of applying a sufficient number of ruffles to enable one inch of overlap in the border material as it is being sewn in its upside down orientation, a greater number of ruffles for forming a substantially greater amount of overlap, typically will be formed thereon to provide the increased amount of overlap required, for example, 3 to 4 inches, when the foundation border material is inverted or turned over for attachment to the foundation frame. Alternatively, for "Euro-top" style borders, the border material will be fed in its normal, upwardly facing orientation with a first edge of the border material being sewn directly along the edge of the panel with a sufficient number or ruffles or pleats generally being formed therein to provide a desired amount of overlap radius for the panel and border when the panel is applied to a foundation frame.

Once a sewing operation has been completed and the border has been attached about all four sides and corners of the panel, the ruffler and folder assembly typically will be lifted and/or pivoted away from the sewing zone to enable easy operator access to the border material. The operator then can trim the completed border from the supply of border material being fed into the sewing zone as closely as possible. The cut ends 209 of the border are typically closed in a second sewing operation, either at the attachment station 10 (FIG. 1A) of the present invention, or in a separate, downstream sewing operation. The completed panel and foundation border thereafter can be affixed to a foundation frame such as for a mattress, box springs, etc., which operation typically will be accomplished at a downstream sewing station.

Accordingly, the present invention thus provides a system or station for forming, ruffling, and attaching gussets and borders for mattresses, box springs, pillowtops and other bedding materials. Further, by adjusting the width of the folder or guide plates of the folder or guide assembly and/or the positioning of the folder or guide assembly itself with respect to the sewing needle of the sewing station, the system of the present invention can be used for forming, sewing, and ruffling varying sizes and types of attachment gussets to mattress panels for pillowtop and other types of mattresses, and also can be used to form, ruffle and sew borders to mattress panels to form various types of borders, including Euro-top style borders and Continental style foundation borders. As a result, the present invention thus provides a system or station or forming, ruffling, and attaching gussets and borders for mattresses, box springs, pillowtops and other bedding materials at a single station with a minimal amount of adjustments required to perform different sewing operations.

It further will be understood by those skilled in the art that while the present invention has been described above with reference to specific embodiments and features, various changes, additions, deletions and modifications can be made thereto without departing from the spirit and scope of the invention.

What we claim is:

1. A method for finishing an attachment gusset for a mattress, comprising:

moving a panel, with tension applied thereto, through a sewing zone;

feeding a length of gusset material from a supply;

receiving and directing the gusset material through a folder assembly into the sewing zone in a substantially flat lying attitude into engagement with the panel;

attaching the gusset material about a peripheral edge of the panel;

as a corner of the panel approaches the sewing zone, halting the application of tension to the panel and forming a series of ruffles in the gusset material as the gusset material is attached about the corner of the panel; and as an initially sewn portion of the panel approaches the sewing zone, cutting and folding a trailing end of the gusset material and sewing the folded trailing end to the panel.

2. The method of claim 1 and wherein feeding a length of gusset material comprises engaging the gusset material with a series of pre-feed rolls and pulling the gusset material from the supply.

3. The method of claim 2 and further comprising monitoring the length of gusset material and controlling operation of the pre-feed rolls to feed the gusset material as needed to maintain a desired amount of gusset material available for sewing to the panel.

4. The method of claim 1 and wherein feeding a length of gusset material comprises passing the gusset material from the supply through a pre-flange station and attaching a flanging material to the gusset material.

5. The method of claim 1 and wherein applying tension comprises extending a tension element into engagement with the panel to create a drag on the panel.

6. The method of claim 1 and further comprising adjusting at least one guide of the folder assembly for folding the gusset material by a desired amount.

7. The method of claim 1 and wherein receiving and directing the gusset material through a folder assembly comprises feeding the gusset material through a passage between a series of spaced folder plates and guiding the gusset material into the sewing zone.

8. The method of claim 1 and further comprising lifting and moving the folder assembly away from the sewing zone upon completion of a sewing operation.

9. A system for attaching a length of material to a panel, comprising:

a sewing station adapted to receive and sew the length of material to the panel, the sewing station including at least one needle defining a sewing zone;

an adjustable folder assembly for guiding the length of material toward the sewing zone; and a ruffler mechanism positioned adjacent said sewing zone for engaging and forming a series of ruffles in the length of material at desired locations along the length of material as the length of material is sewn to the panel;

wherein said folder assembly and ruffler mechanism are pivotally mounted adjacent said sewing station so as to be moveable toward and away from said sewing zone.

10. The system of claim 9 and wherein said folder assembly comprises a series of folder plates spaced from each other so as to define a passage through which the length of material is received, and at least one adjustable guide moveable laterally between said folder plates for adjusting an amount of folding of the length of material as it passes through said folder assembly.

11. The system of claim 10 and further comprising a pivoting support to which said folder plates are mounted.

12. The system of claim 10 and wherein folder plates are mounted to said ruffler mechanism and said ruffler mechanism is mounted on a pivoting support to enable said ruffler mechanism and said folder assembly to be moved away from said sewing zone.

13. The system of claim 9 and wherein said folder assembly and said ruffler mechanism are mounted on a pivoting support to enable movement of said folder assembly and ruffler mechanism away from said sewing zone.

14. The system of claim 13 and wherein said folder assembly includes an adjustable mounting to enable movement of said folder assembly with respect to said needle as needed for adjusting the position of the length of material being sewn with respect to said needle.

15. The system of claim 9 and wherein said ruffler mechanism comprises a ruffler blade and an actuator for moving said ruffler blade into engagement with the length of material as the length of material is sewn about a corner of the panel.

16. The system of claim 15 and wherein said actuator comprises an air cylinder.

17. The system of claim 9 and further comprising a tension mechanism adjacent said sewing zone for applying tension to the panel as the length of material is sewn to the panel.

18. The system of claim 17 and wherein said tension mechanism further comprises a tension member and an actuator adapted to move said tension member into and out of engagement with the panel to apply tension to the panel as the panel approaches said sewing zone.

19. The system of claim 9 and further comprising a pre-flange station upstream of said sewing station for applying a flanging material to the length of material prior to its being fed into said sewing station.

20. The system of claim 9 and further comprising a pre-feed system for feeding the length of material from a supply into the sewing station.

21. The system of claim 20 and wherein said pre-feed system comprises a series of puller rolls and a drive motor for driving at least a portion of said puller rolls for feeding a substantially continuous supply of length of material to said sewing station.

22. The system of claim 21 and further comprising a sensor positioned to monitor a slack portion of the length of material between said sewing station and said supply, wherein said sensor sends a signal indicating a reduction in the slack portion, in response to which said drive motor drives said puller rolls to feed additional amounts of the length of material as needed to maintain a desired amount of slack.

23. A method for forming and attaching a border or gusset to a work piece, comprising:

feeding a length of border or gusset material from a supply;

guiding the border or gusset material into a sewing zone including adjusting the feeding of the border or gusset material with respect to a sewing needle at the sewing zone to set a spacing of a first edge of the border or gusset material from an edge of the work piece to a location at which the border or gusset material is sewn to the work piece;

attaching the border or gusset material to the edge of the work piece at a location spaced from a first edge of the border or gusset material;

as a corner of the work piece approaches the sewing zone, forming a series of ruffles in the border or gusset material as the border or gusset material is sewn about the corner of the work piece;

continuing to sew the border or gusset material to the work piece about each corner thereof until an initial sewing point approaches the sewing zone; and cutting the border or gusset material and attaching a cut edge of the border or gusset material adjacent the initial sewing point to complete a sewing operation.

24. The method of claim 23 and wherein forming a series or ruffles in the border or gusset material comprises forming a sufficient number of ruffles to enable cupping of corner portions of the border or gusset material.

25. The method of claim 24 and further comprising inverting the work piece after the border or gusset has been sewn thereto and applying cupped corner portions of the border about each corner of a foundation frame, with the work piece and a first portion of the border on top of the foundation frame and with a second portion of the border extending downwardly therefrom along sides of the foundation frame.

26. The method of claim 23 and wherein feeding a length of border or gusset material comprises engaging the border gusset material with a series of pre-feed rolls and pulling the border or gusset material from the supply.

27. The method of claim 26 and further comprising monitoring a slack portion of border or gusset material pulled from the supply and controlling operation of the pre-feed rolls to feed the border and gusset material as needed to maintain a desired amount of slack of the border or gusset material available for sewing to the work piece.

28. The method of claim 23 and further attaching a flanging material to the border or gusset material prior to feeding into the sewing zone.

29. The method of claim 23 and wherein guiding the border or gusset material into the sewing zone includes passing the border or gusset material through an adjustable folder assembly.

30. The method of claim 29 and wherein adjusting the feeding of the border or gusset material comprises moving the folder assembly with respect to the sewing needle of the sewing zone to set a desired location along the border or gusset material at which the border or gusset material will be sewn to the work piece edge.

31. A method for forming and attaching a border or gusset to a work piece, comprising:

feeding a length of border or gusset material from a supply;

guiding the border or gusset material into a sewing zone;

attaching the border or gusset material to an edge of the work piece at a location spaced from a first edge of the border or gusset material;

as a corner of the work piece approaches the sewing zone, forming a series of ruffles in the border or gusset material by forming a sufficient number of ruffles to enable cupping of corner portions of the border or gusset material as the border or gusset material is sewn about the corner of the work piece;

continuing to sew the border or gusset material to the work piece about each corner thereof until an initial sewing point approaches the sewing zone;

cutting the border or gusset material and attaching a cut edge of the border or gusset material adjacent the initial sewing point to complete a sewing operation; and inverting the work piece after the border or gusset has been sewn thereto and applying cupped corner portions of the border about each corner of a foundation frame, with the work piece and a first portion of the border overlying the foundation frame and with a second portion of the border extending downwardly therefrom along sides of the foundation frame.

32. A method for forming and attaching a border or gusset to a work piece, comprising:

feeding a length of border or gusset material from a supply;

guiding the border or gusset material into a sewing zone and into a position overlying a portion of the work piece and spaced from an edge of the work piece by passing the border or gusset material through an adjustable folder assembly;

attaching the border or gusset material to the edge of the work piece at a location spaced from a first edge of the border or gusset material;

as a corner of the work piece approaches the sewing zone, forming a series of ruffles in the border or gusset material as the border or gusset material is sewn about the corner of the work piece;

continuing to sew the border or gusset material to the work piece about each corner thereof until an initial sewing point approaches the sewing zone; and cutting the border or gusset material and attaching a cut edge of the border or gusset material adjacent the initial sewing point to complete a sewing operation.

* * * * *